United States Patent [19]

Johnson

[11] Patent Number: 4,716,715

[45] Date of Patent: Jan. 5, 1988

[54] TEACHING SADDLE

[76] Inventor: Naomi H. Johnson, Rte. 3, Box 143-A, Raeford, N.C. 28376

[21] Appl. No.: 902,494

[22] Filed: Sep. 2, 1986

[51] Int. Cl.[4] ..... B68C 1/02

[52] U.S. Cl. ..... 54/44

[58] Field of Search ..... 54/44, 66

[56] References Cited

U.S. PATENT DOCUMENTS

| | | | |
|---|---|---|---|
| 307,615 | 11/1884 | Adams et al. | 54/44 |
| 862,572 | 8/1907 | Maussner | 54/44 |
| 909,385 | 1/1909 | Fachiri | 54/44 |
| 3,112,592 | 12/1963 | Schindler | 54/44 |
| 3,286,440 | 11/1966 | Walker et al. | 54/44 |
| 3,312,040 | 4/1967 | Nuzzo | 54/44 |

*Primary Examiner*—Robert P. Swiatek

[57] ABSTRACT

A saddle designed for an instructor riding in tandem with a student is constructed of a layered assembly including a felt underlayer, an outer, leather cover and an inner foam cushion member. The inner foam cushion is stitched between the felt and leather layers in the approximate mid-portion of the saddle to define primary and auxiliary seating areas. The primary seat portion is to the rear of the saddle and the auxiliary seat is forward and generally serves the student. A leather hand grip is attached to the front of the saddle for use by the occupant of the forward seat. Two pairs of stirrups are attached to the sides of the saddle, one pair associated with each seat.

5 Claims, 5 Drawing Figures

TEACHING SADDLE

BACKGROUND AND SUMMARY OF THE PRESENT INVENTION

The art of teaching horseback riding involves instruction in many physical functions including balance, use of the hands, legs, and feet, and also in use of the voice. All of these functions are combined to enable the rider to control the horse and maximize the enjoyment of riding. In the past, most teaching is done by an instructor who is off the horse and attempting to verbally instruct the student rider who is on the horse.

When it is desirable to be on the horse with the student, doing so is exceptionally difficult because of conventional design of English or western saddles. Frequently the instructor sits behind the saddle and attempts to handle the reins and work with the student who is on the saddle. Such positioning can make it very difficult for the instructor to get a sense of the student's balance and use of physical coordination in riding. Additionally, it can also be difficult from such a position to control a horse that may be highly annoyed at having two riders thereon.

Horseback riding has become a relatively new approach for use in physical therapy and also in recreational therapy for handicapped persons. Therapists have discovered that riding not only provides a great deal of physical therapy in that it stimulates healing and/or development in many groups of muscles, but riding also has been found to be beneficial in mental therapy. When riding is being taught or utilized as a therapeutic method, the ability of the instructor actually to be on the horse with the student is extremely important. Not only is the instructor better able to determine how the student is responding and progressing, but in many instances the student is completely unable to remain on the horse or control the horse without the instructor.

Existing saddles used for training or riding in tandem have proved unsatisfactory in many ways. U.S. Pat. Nos. numbered 3,112,592; 3,234,710; 3,266,218; 3,916,604; and 4,362,003 all disclose "piggyback" or small auxiliary saddles which are attached to primary, full-size English or Western saddles. U.S. Pat. No. 3,916,604 is specifically directed to a training saddle wherein a smaller training saddle is removably attached to the horn on a full-size saddle. Saddles of this type do not enable the student to obtain a true sensation of riding such as is obtained by mounting the primary saddle and being able to feel or sense the movement and response of the horse. Such saddles are also subject to failure during riding because the auxiliary saddle may become disengaged from the primary saddle. Further, use of many such saddles requires use of a primary saddle of a particular type.

It was to overcoming such problems that the present inventor turned in developing the saddle disclosed herein. The improved saddle is of a design which enables two riders to comfortably mount a horse and ride in tandem on the single saddle. The one saddle comfortably seats two, includes two sets of stirrups, and a hand grip at the front of the saddle for the student or forwardly seated rider to grip.

The present saddle is particularly well suited for teaching very young children to ride, or for therapeutic use with handicapped children or adults. The student or young rider is mounted in front of the instructor on a forward seat portion having a pair of stirrups associated therewith. The student uses the hand grip at the front of the saddle to maintain balance. The instructor is preferably seated behind the student on the second, rear seat portion and grasps the reins around the student. From this position the instructor has full control of the horse and can also sense the responses and movement of the student.

Because the student is seated directly on the saddle, rather than on a secondary, auxiliary saddle, the student gets full benefit of the riding experience; sensing firsthand the movements and behavior of the horse. Yet, because the instructor is on the horse with the student, the student has a sense of security that enables him or her to relax and enjoy the experience to the maximum. Such positive instruction and riding experiences are virtually impossible with previously known training saddles.

The unique training saddle is generally of a layered construction having an upper, outer layer of leather; a supporting underlayer, preferably made of felt; and a cushioning member of foam rubber stitched between the two layers. The cushion member is positioned in the approximate middle of the layers, and is configured to define the aforementioned front and rear seat portions. The hand grip is comprised of a length of leather rolled and stitched to form a strap that is stitched by each end thereof to the front of the saddle. Billet straps and a standard girth are attached to the felt underlayer. Stirrup bars are also attached to the underlayer for receiving a first pair of stirrups associated with the forward seat portion, and a second pair of stirrups associated with the rear seat portion. Generally, the first pair of stirrups are of a shorter, smaller size to accomodate a young student. However, it is obvious that both pairs of stirrups can be adult size if required.

A separate, one-inch thick foam rubber pad, cut to fit under the training saddle is used for the comfort and protection of the horse.

Thus designed, the present invention satisfies a primary objective of providing a single saddle which will accomodate two persons riding in tandem. Another primary objective is met in the provision of a training saddle whereby the instructor and the student are mounted on a single saddle and the student can accurately sense the actions and response of the horse, and the instructor can immediately determine the student's reactions thereto.

Other and further objectives and advantages will become obvious to those skilled in the art as the following detailed description is studied in conjunction with the accompanying drawings.

DETAILED DESCRIPTION OF A PREFERRED EMBODIMENT

Figure 1:
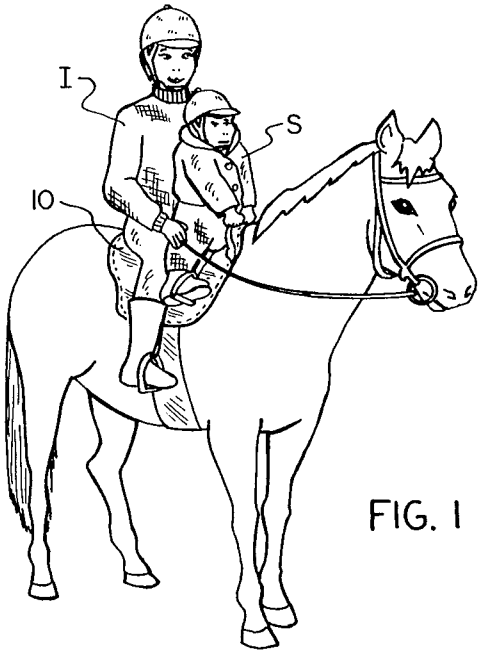
FIG. 1 is a front perspective view of the present invention with instructor and student seated thereon.
Figure 2:
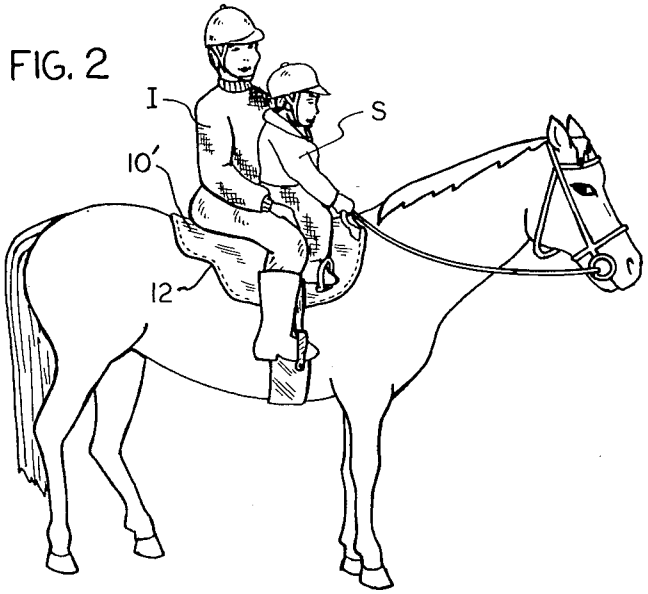
FIG. 2 is a side view of FIG. 1.

FIG. 1 illustrates the preferred mount whereby the instructor I is seated to the rear of the saddle 10 with the student or child S in front. The saddle 10' shown in FIG. 2 is identical in construction, apart from the cutaway portion 12 to the rear of the saddle. The cutaway 12 is a design choice and has no pertinence to overall construction or use of the saddle.

Figure 3:
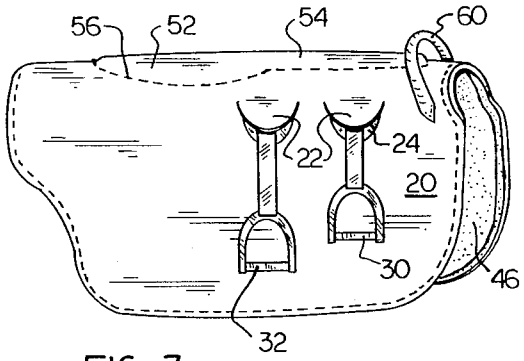
FIG. 3 is a side elevation of the preferred embodiment of the present invention.
Figure 4:
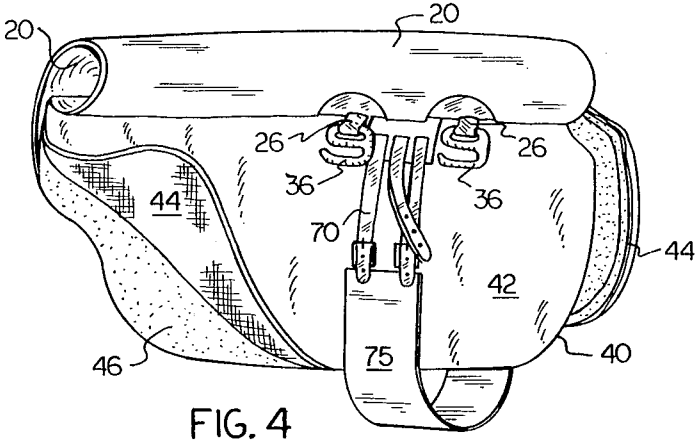
FIG. 4 is a side elevation of the saddle of FIG. 3, showing the outer layer lifted up and folded back to reveal the underlayer.
Figure 5:
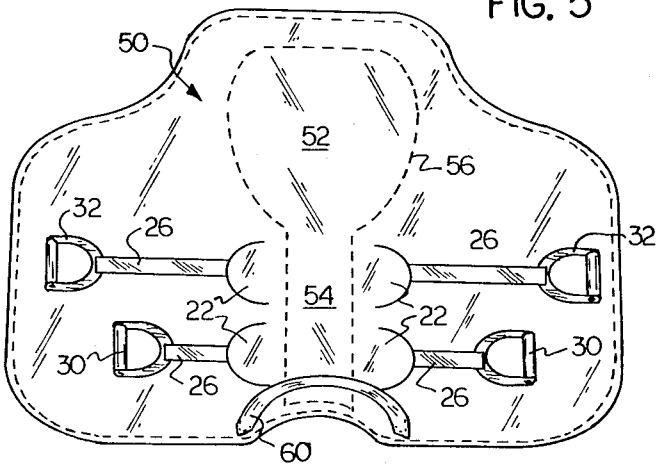
FIG. 5 is a top plan view illustrating the saddle in a flattened position.

FIGS. 3 through 5 disclose the saddle in detail. The layered construction generally includes an outer cover layer or skirt 20 preferably made from a quality leather, although synthetic leather materials could be utilized. The outer layer 20 includes a pair of flaps 22 overlying opening 24 through which stirrup straps 26 extend.

As illustrated, the saddle 10 is outfitted with two pairs of stirrups. The forward stirrups 30 as shown are fitted to a child's length, and the second pair, 32, are fitted to an adult. However, as obvious, both pairs 30 and 32 are adjustable to any rider. Further, removable or breakaway stirrup bars can be utilized as desired.

Stirrup bars 36 are attached to the inside surface of the saddle underlayer 40. Stirrup straps 26 are attached to the stirrup bars 36 as shown in FIG. 4.

The supporting underlayer 40 is preferably made from heavy wool felt material approximately one inch thick. The underlayer 40 may further include an outer, facing layer 42 made from soft leather or synthetic leather. When so faced, it is preferred that an undersurface 44 be of the felt for comfort and protection of the horse.

For additional protection of the horse, a separate layer 46 of foam material or other cushioning material is cut to a shape and size to fit under the saddle. The foam layer 46 is preferably at least one inch thick.

As shown in FIGS. 3 and 5, a cushion member 50 is stitched into place to define two seating areas 52 and 54. The cushion is comprised of a foam pad sandwiched between layers 20 and 40 and stitched into place along stitching line 56. The general shape includes a rounded rearward seat portion 52 and a forward, narrow seat portion 54. As previously explained, the preferred embodiment is designed primarily for use by adult instructor and very young children, or parent and child. For such use, the illustrated seat design with an enlarged rear seat 52 is adequate. However, for modification for use by two adults, the seating configuration and the shape of cushion 50 might be changed accordingly.

Along the leading edge of the saddle a hand grip 60 is stitched into place. The grip 60 is an elongated piece of rolled leather, rolled for comfort in the hand, stitched by each end to the saddle, and used by the student or leading rider to maintain balance.

Conventional billet straps 70 are stitched between the two layers 20, 40, and are attached to a standard girth 75. Dimensions of the saddle will vary but the illustrated skirt 20 measures approximately twenty-eight to thirty inches from front to rear and approximately twenty to twenty-four inches long, measured from the center of the saddle to the lower edge. While other and further modifications may be made, it is believed that most such modifications will fall within the scope of the invention which is limited only by the scope of the claims below.

What is claimed is:

1. An extra-long treeless saddle designed for two persons riding in tandem; said saddle including:

(a) a rear primary seat portion and a forward auxiliary seat portion;

(b) a first pair of stirrups associated with the sides of said auxiliary seat portion and a second pair of stirrups associated with said primary seat portion, i.e., forward rider uses first pair of stirrups and rear rider uses second pair of stirrups;

(c) a layered construction having a first, underlayer forming support pad of prescribed thickness, and a second, outer layer forming a skirt; and (d) an inner cushion member secured between said skirt and said underlayer, and underlying said primary and auxiliary seat portions; said cushion member being formed of a material having thickness and resilience sufficient to cushion and protect the riders;

whereby a parent and child, instructor and student, handicapped rider and back-rider, or any combination of two riders may ride in tandem in comfort and safety without use of seats secondarily attached to a conventional saddle.

2. A tandem saddle according to claim 1 and further including conventional billet straps and stirrup bar attachments for rider safety and ease of adjustment and a hand grip attached to a pommel of said saddle whereby a rider in the forward seat portion may grip said hand grip while riding.

3. A tandem saddle according to claim 1 wherein said cushion member is formed of a resilient foam material, and is stitched into position between said first and second layers.

4. A tandem saddle according to claim 1 and further including a saddle pad underlying said tandem saddle for protecting the horse; said saddle pad being separate from said saddle and comprised of a resilient cushion material of a size and dimension to be concealed underneath said saddle.

5. A tandem saddle according to claim 4 wherein said saddle pad is comprised of a foam material having a thickness of at least one inch.

* * * * *